United States Patent [19]

Clay

[11] 4,326,186

[45] Apr. 20, 1982

[54] OFF-CENTERED HOUR GLASS SHAPED COIL SPRING AND THERMAL SWITCH INCORPORATED INTO SAME

[75] Inventor: Murray G. Clay, Coral Gables, Fla.

[73] Assignee: Littelfuse, Inc., Des Plaines, Ill.

[21] Appl. No.: 128,549

[22] Filed: Mar. 10, 1980

[51] Int. Cl.[3] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 3,309,481 | 3/1967 | Merrill | 337/407 X |
| 3,781,737 | 12/1973 | Henry | 337/407 |
| 4,001,754 | 1/1977 | Plasko | 337/407 |
| 4,281,309 | 7/1981 | Olson | 337/409 |

*Primary Examiner*—George Harris

*Attorney, Agent, or Firm*—Wallenstein, Wagner, Hattis, Strampel & Aubel

[57] ABSTRACT

An off-centered hour glass shaped coil spring, having a particular utility in thermally responsive switches to bias a sandwich of switch forming elements including a pellet of meltable material and comprising outermost spiral turns which are the coils of maximum diameter at opposite ends of the coil, and off-centered intermediate turns of lesser diameter between the same. These various turns of the coil are such that when the coil spring is compressed, the contiguous portions of the turns will overlap partially and nestle together, so that the longitudinal dimensions of the compressed spring are reduced from that of a conventional coil spring of the same size.

7 Claims, 11 Drawing Figures

OHMMETER

OFF-CENTERED HOUR GLASS SHAPED COIL SPRING AND THERMAL SWITCH INCORPORATED INTO SAME

BACKGROUND AND SUMMARY OF INVENTION

This invention relates to coil springs and to thermally actuated cut-off links (also referred to commonly as thermal fuses or cut-offs) and normally open switches in which such springs are incorporated. Such cut-off links and switches respond to the ambient temperature surrounding the same by opening or closing an electric circuit when the ambient temperature reaches a control value. Normally, closed versions of such thermally actuated cut-off links, for example, are frequently physically incorporated into the windings of electric motors and in other devices requiring thermal protection and electrically connected in series with such devices so that the cut-off links will de-energize the devices involved when the ambient temperature exceeds a given safe value.

Ambient thermally actuated cut-off links commonly comprise a metal casing and a sandwich of elements including a fusible pellet, contact-making elements, and springs which impose forces on the elements including the pellet which cause a desired rapid opening of the contacts involved when the ambient temperature involved reaches an undesired level which melts the fusible pellet. It is important that slight creeping of the pellet does not materially change the opening characteristics of the cut-off link. Usually the springs referred to comprise relatively weak and strong coil springs, the stronger of which keeps the weaker one fully compressed and takes up the slack in the sandwich of elements caused by tolerance variations and creeping of the pellet. It is especially desirable that the latter spring be compact as well as being capable of following any pellet creeping.

Using conventional coil springs for this purpose was found unsatisfactory in a recently developed cut-off link construction where one and preferably at least two outwardly inclining deformable contact-forming arms were preferably formed at the inner end of a power lead and forced against a backing member to expand the arms into good contact-making engagement with the conductive inner surface of the casing. The backing member forms one of the elements of a sandwich of elements extending between the casing ends. This sandwich of elements comprises a fusible pellet, a pressure distributing disc, a first partially compressed spring for taking up any play in the sandwich of elements, said backing member, arm-deforming means positioned contiguous to and adapted to collapse said arms when released to do so, and a second fully compressed spring held fully compressed by the first spring and applying a force acting on said deforming means to force it into an arm-collapsing position when the pellet melts.

In the initial design of the spring, the partially compressed spring was a conical spring whose wide end pressed against the peripheral portions of the pressure-distributing disc. The specifications of fuse manufacturers for cut-off links places a maximum limit on the overall size of the cut-off links. It was found that using conventional conical or cylindrical coil springs that, to obtain the necessary strength and expandability of such a spring to keep the other coil spring fully compressed, required a spring of such a length that it was not possible to make a cut-off link with the desired small length.

In accordance with the present invention, a unique coil spring was invented which enables this spring to be of exceedingly small size in its collapsed condition, while having the capability of following any creeping of the fusible pellet and retaining sufficient force to keep the other coil spring fully compressed. This hour glass shaped coil spring is preferably made of music wire. The coil spring has outermost spiral turns which are the coils of maximum diameter, and off-centered turns of lesser diameter between the same. The various turns of the coil are off-centered in a manner so that when the coil is compressed, the contiguous portions of the turns will overlap and nestle together, so that the longitudinal dimensions of the compressed spring are reduced from that of a conventional coil spring.

DESCRIPTION OF EXEMPLARY EMBODIMENTS OF THE INVENTION

Figures 1, 2, 3, 4, 5, 6, 7, 8, 9, 10, 11:
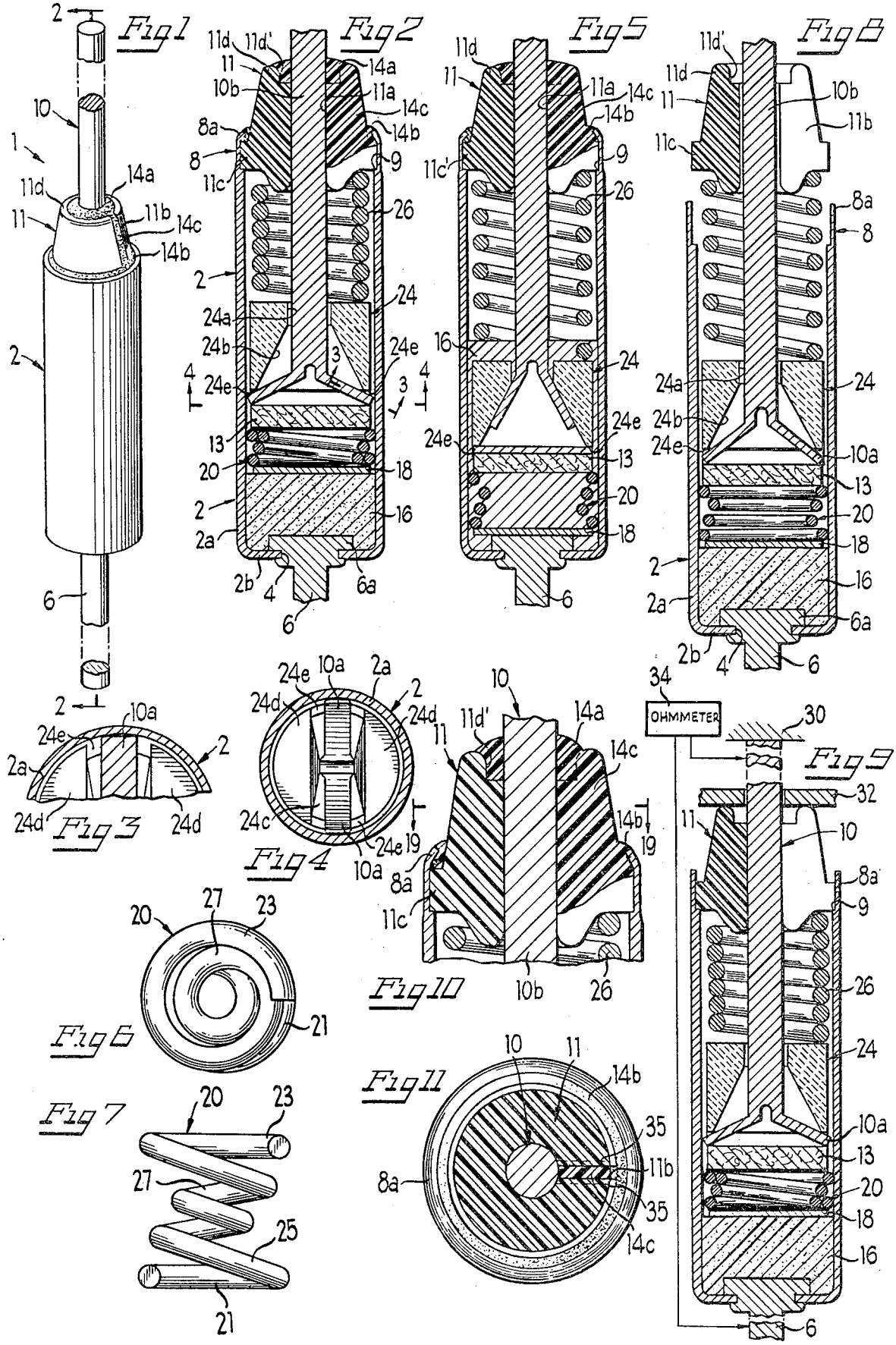
FIG. 1 is a perspective view, enlarged several times the actual size thereof, of a normally-closed ambient thermally actuated cut-off link constructed in accordance with the present invention.
FIG. 2 is a longitudinal sectional view through the cut-off link of FIG. 1, taken along section line 2—2 therein.
FIG. 3 is an enlarged fragmentary transverse section through the cut-off link shown in FIG. 2, taken along section line 3—3 therein.
FIG. 4 is a transverse sectional view through the entire cut-off link shown in FIG. 2, taken along section line 4—4 therein.
FIG. 5 is a sectional view corresponding to FIG. 2 after the cut-off link has been blown.
FIG. 6 is an elevational view through a unique hour glass-shaped coil spring in its uncompressed state, and which is incorporated in a compressed state in the cut-off link shown in FIGS. 2 and 5.
FIG. 7 is an end view of the coil spring of FIG. 6.
FIG. 8 illustrates the initial step in the assembly of the parts of the cut-off link of FIGS. 1–5, and shows the insertion of a sandwich of elements loosely within the initially open upper-end of the casing of the cut-off link.
FIG. 9 illustrates the application of external downward forces upon a split-closure member and power lead, which forces compress opposed coil springs and expand contact-forming arms of its power lead into contact with the inner walls of the casing as measured by an ohmmeter diagramatically shown in FIG. 9.
FIG. 10 shows an enlarged sectional view of the upper-end of the cut-off link assembly shown in FIG. 9 after the split closure member has been contracted snugly around the power lead as the upper edge of the casing has been crimped tightly around the closure member to fix the position of the closure member, the power lead and other elements of said sandwich of elements within the casing, and after the application of an epoxy sealing cement over the previously exposed points of juncture between the closure member and casing and power lead.
FIG. 11 is a horizontal sectional view through the closure member of FIG. 10, taken along section line 11—11 therein.

Referring now more particularly to FIGS. 1 through 5, the ambient thermally actuated normally-closed cut-off link there shown and generally indicated by reference number 1 includes a metal casing 2, which may be made of brass and has cylindrical walls 2*a*, which is preferably silver plated on the inside to a thickness of about 0.0002". The casing is initially open at one end and closed by an end wall 2*b* at the other end. The end wall 2*b* has an opening 4 through which a power lead 6 passes. The power lead terminates in an enlarged head 6*a* and is swaged over the outside of the casing end wall 2*b* to form a tight, low resistance, hermetically sealed connection therewith. The power lead 6 may comprise a tin plated copper wire.

The open end of the cylindrical wall 2*a* has a reduced readily deformable skirt 8 having an end portion 8*a* swaged tightly to the flange 11*c* at the outer periphery of a closure member 11 made of a resilient compressible insulating material, which maybe a high temperature resin (like TORLON grade 4203, manufactured by Amoco Chemicals Corporation). The closure member 11 bears against a shoulder 9 formed at the juncture between the reduced skirt 8 and the thicker portion of the cylindrical wall 2*a* of the casing 2. The closure member 11 has an opening 11*a* therein through which passes the shank portion 10*b* of a power lead 10 extending into the initially open end of the casing 2.

The closure member 11 is split at 11*b* along the entire length thereof so as to form a split ring-like member where said opening 11*a* is initially larger than the diameter of the cylindrical shank portion 10*b* of the power lead 10. The split closure member 11 is forced snugly around the power lead 10 by the force of the end portion 8*a* of the casing skirt 8 swaged therearound. The outer end of the closure member 11 has an annular neck portion 11*d* which defines with the shank portion 10*b* of the power lead 10 an annular well 11*d*'. A glob 14*a* of epoxy cement fills this well 11*d*' to form a hermetic seal between the power lead 10 and closure member 11. A glob 14*b* of epoxy cement is also placed over the circular line of juncture between the swaged end portion 8*a* of the casing skirt 8 and the closure member 11.

The power lead 10 in the proposed commercial form of the invention is an annealed, 18 gauge copper wire having a tensile strength of 30,000–35,000 lbs. per square inch and a 0.0002" coating of silver thereover. The power lead 10 may be formed from a cylindrical stock of copper wire with longitudinally elongated and spaced apertures. The copper wire stock is then cut laterally along the apertures to form individual power leads each having a longitudinal open slot at the end thereof, the portion of each lead on opposite sides of the end portion of each slot being bent outwardly to form a bifurcated end defining contact-forming wings or arms 10*a*—10*a*. The copper power lead is then silver plated.

The power lead 10 passes through part of a spring biased sandwich of elements to be described which extends between the closure member 11 and the end wall 2*b* of the casing 2. The contact-forming arms 10*a*—10*a* at the then inner end of the power lead 10 are pressed against a backing member 13 which expands the arms 10*a*—10*a* into engagement with the cylindrical silver coated inner wall surface of the cylindrical wall 2*a* of the casing 2. The copper wire used to form the power lead 10 is preferably a soft readily deformably copper so that the arms 10*a*—10*a* when expanded into engagement with the silver coated inner walls of the casing 2 will deform somewhat to make contact over a given area greater than that provided by a point contact with the casing, as best illustrated in FIGS. 2 and 3, ensuring an unusually total low contact resistance of, for example, under 1 milliohm per cut-off link. In the assembly of the cut-off link 1, before the split closure member 11 is contracted around the power lead 10, the contact resistance between the arms 10*a*—10*a* and the casing walls is adjusted to a given desired low value by progressively increasing the inward pressure of the power lead against the backing member 13 until a measurement of this contact resistance reaches the desired value. The split closure member 11 is then squeezed tightly around the power lead by crimping the casing skirt around the closure member flange 11*c* before the adjusted pressure is removed from the power lead. (This adjustment procedure will be more clearly described later on in the specification in connection with the description of FIGS. 8–10).

The aforementioned sandwich of elements includes, in addition to the backing member 13, a pellet 16 of fusible material which will melt at a given control temperature, a metal pressure-distributing disc 18, a relatively short, strong coil spring 20, an insulating arm-deforming member 24 and a relatively weak, long coil spring 26. The coil springs 20 and 26 may be made of music wire. The pellet 16 is located between the head 6*a* of the power lead 6 and the pressure-distributing disc 18. The pellet is preferably formed by compacting a granular mixture of fusible material against the closed end of the casing. This achieves a much more intimate engagement between the fusible material and the casing walls, to increase heat conductivity to the pellet. If a self-supporting fusible pellet were to be inserted into the open end of the casing 2 during the manufacture of the cut-off link, the pellet would initially have to be of somewhat smaller dimensions than the inside diameter of the casing, which would interfere with the transmission of heat thereto through the walls of the casing if the pellet were not compacted and expanded into intimate contact with the casing wall. While a very soft pellet could be so compacted this would not generally achieve the same intimate contact between the pellet and the casing wall as when a granulated material is compacted. Also, fusible pellets are generally relatively rigid bodies making their substantial compression difficult if not impractical to achieve when placed inside the very tiny casings used for thermal cut-off links.

The relatively short, strong, compressed coil spring 20 is shown in FIG. 2 sandwiched in a partially compressed state between the pressure-distributing disc 18 and the right side of the backing member 13. The coil spring 20 is shown as an hour glass-shaped coil spring. The coil spring 20 has outermost spiral turns 21 and 23 which are the coils of maximum diameter at opposite ends of the coil and are contiguous to the casing walls, and inwardly operating turns 25 and 27 of lesser diameter between the same. When the coil is compressed, the contiguous portions of the turns will overlap partially and nestle together, as shown in FIG. 2, so that the longitudinal dimensions of the required compressed spring are reduced from that of a conventional coil spring. This unique spring construction enables the spring to be of a minimum size in its collapsed condition, while having the capability of following the creeping of the fusible pellet 16 and retaining sufficient force to keep the other coil spring 26 fully compressed.

The arm-deforming member 24, which is preferably made of hard ceramic material, has a pair of flat-ended bosses 24*d*—24*d* bearing against the upper side of the backing member 13 as viewed in FIG. 2. The arm-deforming member 24 is shown having a cylindrical passageway 24*a* through which the power lead 10 freely passes, which cylindrical passageway joins a conically-shaped arm-deforming cavity 24*b* which opens onto the end of the arm-deforming member 24 through an outwardly facing opening 24*c* defined between the bosses 24*d*—24*d*, and also communicates to the exterior of the member through laterally facing openings 24*e*—24*e*, which provide clearance openings for the arms 10*a*—10*a* extending outwardly beyond the confines of the arm-deforming member 24.

The relatively weak, long coil spring 26 is fully compressed between the arm-deforming member 24 by the force of the short, strong coil spring 20 which also eliminates any play in the sandwich of elements referred to. Because the coil spring 26 remains fully compressed at all times prior to the melting of the pellet 16, it is apparent that the backing member position remains fixed, and so the pressure and contact resistance between the power lead contact-forming arms 10*a*—10*a* expanded by their engagement with the backing member 13 against the casing 2 remains constant, even if the fusible pellet 16 creeps.

When the environment in which the cut-off link is placed reaches the desired control temperature, the fusible pellet 16 melts, causing the initial expansion of the stronger coil spring 20, following which the larger coil spring 26 will fully expand to force the arm-deforming member 24 downward as viewed in the drawings. The movement of the arm-deforming member 24 downward will collapse the arms 10*a*—10*a* within the cavity 24*b* thereof, as shown in FIG. 5. The pressure-distributing disc 18, as well as the backing member 13 and the arm-deforming member 24, are made of a size somewhat smaller than the interior dimensions of the casing, so that there is clearance for the flow of the melted fusible material throughout the cut-off link, as illustrated in FIG. 5.

To assemble said sandwich of elements within the casing 2, the casing is oriented so that the initially open end thereof which receives the closure member 11 faces upwardly to receive the different parts of this sandwich of elements dropped into the then bottom portion of the casing in the order in which these elements are to be located within the casing, as shown in FIG. 8. (The pellet 16, however, is preferably formed as described by compacting a grannular fuse material into the bottom of the casing 2.) Next, force-applying means, like plungers 30 and 32, are respectively brought down against the upper ends of the power lead 10 and the closure member 11, respectively. As shown in FIG. 9, the plunger 32 is forced downwardly to bring the bottom of the flange 11*c* of the closure member 11 against the shoulder 9 of the casing wall at the inner end of the skirt 8, which is in an undeformed (i.e. straight upwardly extended) position. This positioning of the closure member 11 compresses the springs 20 and 26. An ohmmeter 34 is electrically connected between corresponding points 6 and 10 of the power leads (e.g. at points spaced ½ inch from the exposed inner end portions of these leads.) The plunger 30 is moved downwardly to press the contact-forming arms 10*a*—10*a* against the backing member 13 with a force which causes these arms to spread outwardly against the inner surface of the casing 2 with a force to provide the desired contact resistance between the arms 10*a*—10*a* and the casing walls (which represent most of the resistance measured by the ohmmeter 34). When the ohmmeter measures the desired resistance, which resistance progressively decreases as the downward force on the power lead 10 is progressively increased, the end portion 8*a* of the skirt portion 8 of the casing is then swaged tightly around the flange 11*c* of the closure member so as to contract the split portion 11*b* of the closure member (which initially provided a substantial gap defined between the dashed power lead is maintained after the plunger 30 is removed from the power lead 10.

Next, globs 14*a* and 14*b* and a seam 14*c* of epoxy cement are applied to the space in the split 11*b* in the closure member 11 and to the juncture points between the closure member 11 and the casing 2 and power lead 10 (i.e. over the swaged portion of the casing skirt and adjacent power lead surface and in the well 11*d*), to hermetically seal the initially open end of the casing. The epoxy cement, of course, is initially applied in an uncured, softened condition. The cement is then cured by placing the completed cut-off link in an oven and elevating the same to a desired curing temperature. The particular curing temperature utilized depends upon the temperature rating of the cut-off link. Since curing takes at least several hours, the exact time being an inverse function of the curing temperatures, the highest curing temperature is selected that the pellet 16 can safely withstand. The closure member 11 is made of a high temperature resin material which can withstand the curing temperature involved. (For example, in one case, the curing temperature was 66° C. and the curing time of the epoxy cement utilized was 1 hour.) As previously indicated, the curing of globs 14*a* and 14*b* and seam 14*c* of the epoxy cement does not require any special holding fixtures for the cut-off link, which greatly simplifies the curing process as compared to that required for the normally-closed, cut-off links.

It should be apparent that the present invention provides a unique spring and thermal switch in which it has particular utility.

I claim:

1. An ambient thermal switch comprising: a casing of electrically conductive material; first and second leads in said casing, movable contact-forming means in said casing connected to one of said power leads and making a low resistance contact with another contact surface connected to the other lead; means for separating said movable contact-forming means including a sandwich of elements held under spring pressure between spaced points in said casing and including stressed spring means for applying said spring pressure, said stressed spring means including a compressed hour glass shaped spiral coil spring having relatively wide outer turns on the outside of the spring bearing against adjacent surfaces of said sandwich of elements and gradually inwardly spiraling intermediate turns, the outer and intermediate turns being overlapped and nestled together to minimize the length of the spring in a collapsed condition thereof, and a fusible body of material in said casing which melts at a given temperature to release said stressed spring means which separates said movable contact-forming means from said contact surface.

2. The thermal switch of claim 1 wherein said first lead is extended to the outside of said casing through an opening therein at a point where it is insulated therefrom, said movable contact-forming means being deformable contact-forming arm means at the inner end of said first lead; said arm means being in an outermost position where the same is in contact with an inner conductive surface of said casing which constitutes said contact surface, said sandwich of elements including arm deforming means which when said fusible body melts collapses said contact-forming arm means to separate the same from the casing.

3. The thermal switch of claim 2 wherein said stressed spring means includes a first fully compressed spring means separate from said hour glass shaped coil spring, said arm-deforming means being urged by said fully compressed spring means toward said arm means to deform the same inwardly out of contact with said casing when the fully compressed spring means is allowed to expand, said hour glass shaped spring means keeping said fully compressed spring means fully compressed and taking up any play in said sandwich of elements.

4. The thermal switch of claim 3 wherein said sandwich of elements comprises, in the order named, said fusible body at one end of said casing, said hour glass shaped compressed coil spring, arm-deforming means and said fully compressed spring at the opposite end of the casing.

5. The thermal switch of claim 4 wherein said sandwich of elements includes a backing means for said deformable contact-forming arm means against which backing means said arm means is urged and expanded outwardly against said casing to establish a good low resistance contact therewith.

6. The thermal switch of any of claims 1–5 wherein said hour glass shaped coil spring is made of music wire.

7. The thermal switch of any of claims 1–5 wherein said outermost turns are contiguous to the casing walls.

* * * * *